US010954457B2

(12) United States Patent
Al-Herz et al.

(10) Patent No.: US 10,954,457 B2
(45) Date of Patent: Mar. 23, 2021

(54) METHODS INCLUDING DIRECT HYDROPROCESSING AND HIGH-SEVERITY FLUIDIZED CATALYTIC CRACKING FOR PROCESSING CRUDE OIL

(71) Applicant: Saudi Arabian Oil Company, Dhahran (SA)

(72) Inventors: Mansour Ali Al-Herz, Al-Ahsa (SA); Musaed Salem Al-Ghrami, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/274,709

(22) Filed: Feb. 13, 2019

(65) Prior Publication Data

US 2020/0255753 A1 Aug. 13, 2020

(51) Int. Cl.
*C10G 69/04* (2006.01)
*C10G 11/02* (2006.01)
(Continued)

(52) U.S. Cl.
CPC ..... *C10G 69/04* (2013.01); *C10G 11/02* (2013.01); *C10G 45/08* (2013.01); *C10G 45/12* (2013.01);
(Continued)

(58) Field of Classification Search
None
See application file for complete search history.

(56) References Cited

U.S. PATENT DOCUMENTS 5,318,695 A 6/1994 Eberly et al.
7,019,187 B2 * 3/2006 Powers ..... C10G 9/36 585/648
(Continued)

FOREIGN PATENT DOCUMENTS

WO 2009073436 A2 6/2009
WO 2010009077 A2 1/2010
(Continued)

OTHER PUBLICATIONS

International Search Report and Written Opinion dated Feb. 25, 2020 pertaining to International application No. PCT/US2019/065613 filed Dec. 11, 2019.
(Continued)

*Primary Examiner* — Derek N Mueller
(74) *Attorney, Agent, or Firm* — Dinsmore and Shohl LLP

(57) ABSTRACT

According to at least one aspect of the present disclosure, a method for processing a heavy oil includes introducing the heavy oil to a hydroprocessing unit, the hydroprocessing unit being operable to hydroprocess the heavy oil to form a hydroprocessed effluent by contacting the heavy oil feed with an HDM catalyst, an HDS catalyst, and an HDA catalyst. The hydroprocessed effluent is passed directly to a HS-FCC unit, the HS-FCC unit being operable to crack the hydroprocessed effluent to form a cracked effluent comprising at least one product. The cracked effluent is passed out of the HS-FCC unit. The heavy oil has an API gravity of from 25 degrees to 50 degrees and at least 20 wt. % of the hydroprocessed effluent passed to the HS-FCC unit has a boiling point less than 225 degrees ° C.

24 Claims, 5 Drawing Sheets

(51) Int. Cl.
*C10G 45/08* (2006.01)
*C10G 45/12* (2006.01)

(52) U.S. Cl.
CPC ..... *C10G 2300/202* (2013.01); *C10G 2300/205* (2013.01); *C10G 2300/308* (2013.01); *C10G 2300/4018* (2013.01); *C10G 2400/20* (2013.01)

(56) References Cited

U.S. PATENT DOCUMENTS

| | | | |
|---|---|---|---|
| 8,956,528 | B2 | 2/2015 | Koseoglu |
| 9,096,806 | B2 | 8/2015 | Abba et al. |
| 9,101,853 | B2 | 8/2015 | Koseoglu et al. |
| 9,181,500 | B2 | 11/2015 | Zhu et al. |
| 9,228,140 | B2 | 1/2016 | Abba et al. |
| 2005/0211603 | A1 | 9/2005 | Guillaume et al. |
| 2011/0083996 | A1 | 4/2011 | Shafi et al. |
| 2012/0241359 | A1 | 9/2012 | Al-Thubaiti et al. |
| 2014/0275673 | A1 | 9/2014 | Long et al. |
| 2018/0057758 | A1 | 3/2018 | Al-Ghamdi et al. |
| 2018/0187107 | A1 | 7/2018 | Abudawoud et al. |
| 2018/0346827 | A1* | 12/2018 | Al-Ghamdi ..... B01D 3/143 |

FOREIGN PATENT DOCUMENTS

| | | | |
|---|---|---|---|
| WO | 2010009082 | A1 | 1/2010 |
| WO | 2013142563 | A2 | 9/2013 |
| WO | 2010009089 | A2 | 1/2018 |
| WO | 2018039300 | A1 | 3/2018 |

OTHER PUBLICATIONS

Chen, et al., Novel Propylene Production Route: Utilizing Hydrotreated Shale Oil as Feedstock via Two-Stage Riser Catalytic Cracking, Article, Energy Fuels 2015, 6 pgs.
Corma, et al., Crude oil to chemicals: light olefins from crude oil, Article, The Royal Society of Chemistry 2017, 35 pgs.
Usman, et al., Catalytic cracking of crude oil to light olefins and naphtha; Experimental and kinetic modeling, Article, Institution of Chemical Engineers 2017, 17 pgs.

* cited by examiner

METHODS INCLUDING DIRECT HYDROPROCESSING AND HIGH-SEVERITY FLUIDIZED CATALYTIC CRACKING FOR PROCESSING CRUDE OIL

BACKGROUND

Field

The present disclosure relates to systems and methods for the processing of petroleum-based materials, in particular, systems and methods for processing petroleum-based materials, such as crude oil, through hydroprocessing and high-severity fluidized catalytic cracking to form chemical products and intermediates.

Technical Background

Petrochemical feeds, such as crude oils, can be converted to chemical intermediates such as butene, butadiene, propene, ethylene, and methane, which are basic intermediates for a large portion of the petrochemical industry. These compounds can be produced through fluidized catalytic cracking (FCC) of petroleum gases and distillates such as naphtha, kerosene, or even gas oil in the presence of an FCC catalyst. FCC performed under high-severity conditions has shown the potential for converting low-value refinery streams into high value chemical intermediates. However, the feedstocks available for high-severity fluidized catalytic cracking (HS-FCC) processes are limited and must be obtained through costly and energy intensive refining steps. For example, processes which fractionate the feedstock prior to HS-FCC rely on energy intensive steam cracking to process the lighter fractions, a costly process with little control in the production of desirable products. While crude oil may be a potential feedstock, the concentrations of metal, nitrogen, and sulfur in crude oil contributes to deactivation of the FCC catalysts. Further, it is extremely difficult to efficiently crack a feedstock with a wide boiling point range, such as crude oil, over a single FCC catalyst.

SUMMARY

Accordingly, there is an ongoing need for systems and methods for processing petroleum-based materials, such as a heavy oil, to produce chemical products or intermediates, such as butene, butadiene, propene, ethylene, methane, or other compounds. The systems and methods of the present disclosure include a hydroprocessing unit and an HS-FCC unit downstream of the hydroprocessing unit. The hydroprocessing unit may be operable to hydroprocess the heavy oil feed to form a hydroprocessed effluent by contacting the heavy oil feed with a hydrodemetalization (HDM) catalyst, a hydrodesulfurization (HDS) catalyst, and a hydrodearomatization (HDA) catalyst. The hydroprocessed effluent is passed from the hydroprocessing unit directly to the HS-FCC unit, where the hydroprocessed effluent is contacted with an FCC catalyst under high-severity conditions to crack at least a portion of the hydroprocessed effluent to form a cracked effluent. The systems and methods may result in producing one or more products, such as one or more olefins for example, from a crude oil feedstock without any intermediate steps, such as intermediate separations, which may separate the crude oil into a plurality of fractions.

According to at least one aspect of the present disclosure, a method for processing a heavy oil includes introducing the heavy oil to a hydroprocessing unit, the hydroprocessing unit being operable to hydroprocess the heavy oil to form a hydroprocessed effluent by contacting the heavy oil with an HDM catalyst, an HDS catalyst, and an HDA catalyst. The hydroprocessed effluent is passed directly to an HS-FCC unit, the HS-FCC unit being operable to crack the hydroprocessed effluent to form a cracked effluent that includes at least one product. The cracked effluent may be passed out of the HS-FCC unit. The heavy oil has an American Petroleum Institute (API) gravity of from 25 degrees to 50 degrees and at least 20 weight percent (wt. %) of the hydroprocessed effluent passed to the HS-FCC unit has a boiling point less than 225 degrees Celsius (° C.).

According to one or more other aspects, a method for processing a heavy oil includes hydroprocessing the heavy oil to form a hydroprocessed effluent by contacting the heavy oil with an HDM catalyst, an HDS catalyst, and an HDA catalyst. The hydroprocessed effluent is contacted with a cracking catalyst in a HS-FCC unit to form a cracked effluent comprising at least one product. The heavy oil has an API gravity of from 25 degrees to 50 degrees and at least 20 wt. % of the hydroprocessed effluent passed to the HS-FCC unit has a boiling point less than 225 degrees ° C.

According to one or more other aspects, a system for processing heavy oil may include a heavy oil source; a hydroprocessing unit, the hydroprocessing unit including an HDM catalyst, an HDS catalyst, and an HDA catalyst; and a HS-FCC unit. An outlet of the heavy oil source may be in direct fluid communication with an inlet of the hydroprocessing unit, and an outlet of the hydroprocessing unit may be in direct fluid communication with an inlet of the HS-FCC unit.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
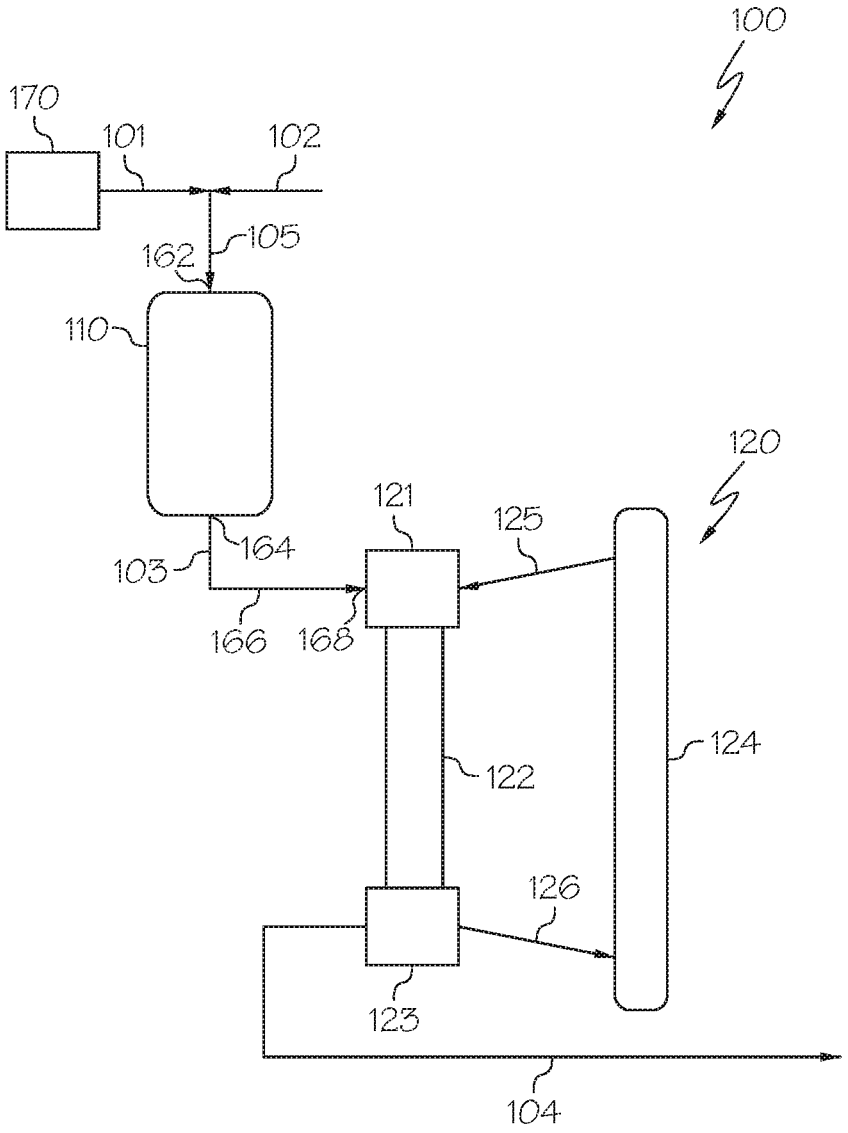
FIG. 1 depicts a generalized schematic diagram of an embodiment of a heavy oil conversion system that includes a hydroprocessing unit and an HS-FCC unit, according to one or more embodiments described in this disclosure.

For the purpose of describing the simplified schematic illustrations and descriptions of FIGS. 1-5, the numerous valves, temperature sensors, electronic controllers and the like that may be employed and well known to those of ordinary skill in the art of certain chemical processing operations are not included. Further, accompanying components that are often included in chemical processing operations, such as refineries, such as, for example, air supplies, catalyst hoppers, flue gas handling, or other related systems are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1-5. Mixing or combining may also include mixing by directly introducing both streams into a like reactor, separation device, or other system component. For example, it should be understood that when two streams are depicted as being combined directly prior to entering a separation unit or reactor, in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

The present disclosure is directed to systems and methods for processing heavy oils, such as crude oil, to produce more valuable chemical intermediates, such as olefins, for example. According to at least one aspect of the present disclosure, a method for processing a heavy oil includes introducing the heavy oil to a hydroprocessing unit, the hydroprocessing unit being operable to hydroprocess the heavy oil to form a hydroprocessed effluent by contacting the heavy oil feed with an HDM catalyst, an HDS catalyst, and an HDA catalyst. The hydroprocessed effluent is passed directly to a HS-FCC unit, the HS-FCC unit being operable to crack the hydroprocessed effluent to form a cracked effluent comprising at least one product. The cracked effluent is passed out of the HS-FCC unit. The heavy oil has an API gravity of from 25 degrees to 50 degrees and at least 20 weight percent (wt. %) of the hydroprocessed effluent passed to the HS-FCC unit has a boiling point less than 225 degrees Celsius (° C.). A system for processing heavy oil is also disclosed and includes a heavy oil source, the hydroprocessing unit, and the HS-FCC unit. The hydroprocessing unit includes an HDM catalyst, an HDS catalyst, and an HDA catalyst. An outlet of the heavy oil source is in direct fluid communication with an inlet of the hydroprocessing unit and an outlet of the hydroprocessing unit is in direct fluid communication with an inlet of the HS-FCC unit.

The systems and methods of the present disclosure may enable crude oil and heavy oils to be used as a feedstock for production of olefins and other chemical products through high-severity fluidized catalytic cracking. The hydroprocessing of the heavy oil may remove metals, sulfur, nitrogen, and aromatic compounds that may cause deactivation of cracking catalysts under high-severity conditions. Thus, the systems and methods of the present disclosure may increase the efficiency of the HS-FCC-based process by reducing catalyst deactivation and reducing the need for adding make-up catalysts. The systems and methods of the present disclosure may also enable crude oil and other heavy oils to be introduced directly to the process without upstream separation processes, such as fractionation columns, that can be costly to construct and operate. Additionally, the systems and methods of the present disclosure may convert crude oil directly to light olefins without the use of steam cracking, which is energy intensive and offers very little control over the ratio of ethylene to propene in the steam cracking effluent.

As used in this disclosure, a "reactor" refers to any vessel, container, or the like, in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed within a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals in a mixture from one another. For example, a separation unit may selectively separate differing chemical species from one another, forming one or more chemical fractions. Examples of separation units include, without limitation, distillation columns, flash drums, knock-out drums, knock-out pots, centrifuges, filtration devices, traps, scrubbers, expansion devices, membranes, solvent extraction devices, and the like. It should be understood that separation processes described in this disclosure may not completely separate all of one chemical consistent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition. Further, in some separation processes, a "light fraction" and a "heavy fraction" may separately exit the separation unit. In general, the light fraction stream has a lesser boiling point than the heavy fraction stream. It should be additionally understood that where only one separation unit is depicted in a figure or described, two or more separation units may be employed to carry out the identical or substantially identical separation. For example, where a distillation column with multiple outlets is described, it is contemplated that several separators arranged in series may equally separate the feed stream and such embodiments are within the scope of the presently described embodiments.

As used in this disclosure, the term "effluent" may refer to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" may more particularly be used to refer to a stream that is passed out of a reactor or reaction zone.

As used in this disclosure, a "catalyst" refers to any substance which increases the rate of a specific chemical reaction. Catalysts described in this disclosure may be utilized to promote various reactions, such as, but not limited to, hydrodemetalization, hydrodesulfurization, hydrodenitrogenation, hydrodearomatization, cracking, aromatic cracking, or combinations thereof.

As used in this disclosure, "cracking" generally refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

It should be understood that the reactions promoted by catalysts as described in this disclosure may remove a chemical constituent, such as only a portion of a chemical constituent, from a process stream. For example, an HDM catalyst may be present in an amount sufficient to promote a reaction that removes a portion of one or more metals from a process stream. A hydrodenitrogenation (HDN) catalyst may be present in an amount sufficient to promote a reaction that removes a portion of the nitrogen present in a process stream. An HDS catalyst may be present in an amount sufficient to promote a reaction that removes a portion of the sulfur present in a process stream. Additionally, an HDA catalyst, such as a hydrocracking catalyst, may be present in an amount sufficient to promote a reaction that converts aromatics, which are hard to crack in the HS-FCC unit, to naphthalenes, paraffinic compounds, or both, which are easier to crack in the HS-FCC unit. It should be understood that, throughout this disclosure, a particular catalyst may not be limited in functionality to the removal, conversion, or cracking of a particular chemical constituent or moiety when it is referred to as having a particular functionality. For example, a catalyst identified in this disclosure as an HDN catalyst may additionally provide hydrodearomatization functionality, hydrodesulfurization functionality, or both.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring now to FIG. 1, a heavy oil conversion system 100 is schematically depicted that includes a hydroprocessing unit 110 and an HS-FCC unit 120 downstream of the hydroprocessing unit 110. The heavy oil conversion system 100 receives a heavy oil 101 and directly processes the heavy oil 101 to form one or more petrochemical products. In some embodiments, the heavy oil 101 may not undergo any pretreatment, separation, or other operation which may change the composition of the heavy oil 101 prior to introducing the heavy oil 101 to the hydroprocessing unit 110 or combining the heavy oil 101 with hydrogen to form a mixed stream 105 that is introduced to the hydroprocessing unit 110. For example, the heavy oil 101 may not be separated (fractionated) into greater and lesser boiling point fractions prior to being introduced to the hydroprocessing unit 110. In some embodiments, the heavy oil conversion system 100 may include a heavy oil source 170. The heavy oil 101 may be passed directly from the heavy oil source 170 to an inlet 162 of the hydroprocessing unit 110.

The heavy oil source 170 may be a storage vessel, pipeline, crude oil production facility, petroleum refinery, or other heavy oil source 170. The heavy oil 101 may include one or more of crude oil, vacuum residue, tar sands, bitumen, atmospheric residue, vacuum gas oils, other heavy oil streams, or combinations of these. In some embodiments, the heavy oil 101 may be crude oil. In some embodiments, the heavy oil 101 may be a crude oil having an American Petroleum Institute (API) gravity of from 25 degrees to 50 degrees. For example, in some embodiments, the heavy oil 101 may include an Arab light crude oil. Example properties for an exemplary grade of Arab light crude oil are listed in Table 1, which is provided subsequently in this disclosure. It should be understood that, as used in this disclosure, a "heavy oil" may refer to a raw hydrocarbon which has not been previously processed (such as crude oil) or may refer to a hydrocarbon which has undergone some degree of processing prior to being introduced to the heavy oil conversion system 100 in the heavy oil 101.

TABLE 1

| Example of Arab Light Export Feedstock | | | |
|---|---|---|---|
| Analysis | Units | Value | Test Method |
| American Petroleum Institute (API) gravity | degree | 33.13 | ASTM D287 |
| Density | grams per milliliter (g/mL) | 0.8595 | ASTM D287 |
| Sulfur Content | weight percent (wt. %) | 1.94 | ASTM D5453 |
| Nitrogen Content | parts per million by weight (ppmw) | 849 | ASTM D4629 |
| Asphaltenes | wt. % | 1.2 | ASTM D6560 |
| Micro Carbon Residue (MCR) | wt. % | 3.4 | ASTM D4530 |
| Vanadium (V) Content | PPmw | 15 | IP 501 |
| Nickel (Ni) Content | PPmw | 12 | IP 501 |
| Arsenic (As) Content | PPmw | 0.04 | IP 501 |
| Boiling Point Distribution | | | |
| Initial Boiling Point (IBP) | Degrees Celsius (° C.) | 33 | ASTM D7169 |
| 5% Boiling Point (BP) | ° C. | 92 | ASTM D7169 |
| 10% BP | ° C. | 133 | ASTM D7169 |
| 20% BP | ° C. | 192 | ASTM D7169 |
| 30% BP | ° C. | 251 | ASTM D7169 |
| 40% BP | ° C. | 310 | ASTM D7169 |
| 50% BP | ° C. | 369 | ASTM D7169 |
| 60% BP | ° C. | 432 | ASTM D7169 |
| 70% BP | ° C. | 503 | ASTM D7169 |
| 80% BP | ° C. | 592 | ASTM D7169 |
| 90% BP | ° C. | >720 | ASTM D7169 |
| 95% BP | ° C. | >720 | ASTM D7169 |
| End Boiling Point (EBP) | ° C. | >720 | ASTM D7169 |

Referring still to FIG. 1, in some embodiments, the heavy oil 101 may be mixed with hydrogen 102 to form a mixed stream 105, which may then be introduced to the hydroprocessing unit 110. In some embodiments, the heavy oil 101 and the hydrogen 102 may be introduced to the hydroprocessing unit 110 independently. In such embodiments, a mixed stream 105 may not be formed. The hydrogen 102 may be supplied from a hydrogen source outside of the system, such as a feed hydrogen stream, or may be supplied from a system recycle stream, as described subsequently in this disclosure in reference to FIG. 5. In some embodiments, the hydrogen 102 may include hydrogen from a combination of sources such as partially being supplied from a feed hydrogen stream and partially supplied from a system recycle stream. The volumetric ratio of hydrogen 102 to heavy oil 101 introduced to the hydroprocessing unit 110 may be from 400:1 to 1500:1, from 600:1 to 1300:1, from 800:1 to 1100:1, or even from 900:1 to 1000:1. The volume ratio of hydrogen 102 to heavy oil 101 may depend on the composition of the heavy oil 101. Hydrogen 102 may be mixed with heavy oil 101 or introduced directly to the hydroprocessing unit 110 as all reactions which occur within the hydroprocessing unit 110 may consume hydrogen as the heavy oil 101 undergoes hydroprocessing. In some embodiments, hydrogen 102 may also be incorporated downstream of the heavy oil 101. In some embodiments, hydroprocessing unit 110 includes multiple reactors, in such embodiments each reactor may be supplied with hydrogen 102 independently or hydrogen 102 may be mixed with heavy oil 101 prior to the first reactor or hydrogen 102 may be mixed with the reaction effluents between each reactor.

The hydroprocessing unit 110 may be operable to at least partially reduce the content of metals, sulfur, and aromatic moieties in the heavy oil 101 to produce a hydroprocessed effluent 103. For example, the hydroprocessed effluent 103 passed out of the hydroprocessing unit 110 may have a content of one or more of metals, sulfur, and aromatic compounds that is less than a content of the one or more of metals, nitrogen, sulfur, or aromatic compounds of the heavy oil 101 by at least 2 percent (%), at least 5%, at least 10%, at least 25%, at least 50%, or even at least 75%. For example, an HDM catalyst may remove at least a portion of one or more metals from the heavy oil 101 and an HDS catalyst may remove at least a portion of the sulfur present in a process stream. Additionally, an HDA catalyst may reduce the amount of aromatic compounds in the heavy oil 101 by saturating and cracking those aromatic portions of those aromatic compounds. The hydroprocessing unit 110 may also optionally be operable to reduce the concentration of nitrogen in the heavy oil 101, the nitrogen being reduced by one or more of the HDM, HDS, or HDA catalyst or by an optional HDN catalyst incorporated into the hydroprocessing unit 110.

According to one or more embodiments, the hydroprocessing unit 110 may include multiple catalyst beds arranged in series. For example, the hydroprocessing unit 110 may comprise an HDM catalyst, an HDS catalyst, and an HDA catalyst, arranged in series. The catalysts of the hydroprocessing unit 110 may comprise one or more metal catalysts selected from the metallic elements in Groups 5, 6, 8, 9, or 10 of the International Union of Pure and Applied Chemistry (IUPAC) periodic table, such as, but not limited to, molybdenum, nickel, cobalt, and tungsten. The metals of the catalysts may be supported on a support. Support materials are described subsequently in this disclosure in relation to the hydroprocessing catalysts used in each reaction zone of the hydroprocessing unit 110. In some embodiments, one or more catalysts utilized to reduce the content of sulfur, metals, or both (such as the HDM and HDS catalysts) may be positioned upstream of a catalyst which is utilized to convert aromatics to compounds that are more easily cracked (such as the HDA catalyst). The hydroprocessing unit 110 may be operated at a temperature of from 300° C. to 450° C. and at a pressure of from 30 bars (3,000 kilopascals (kPa)) to 200 bars (20,000 kPa), such as from 30 bars (3,000 kPa) to 180 bars (18,000 kPa). The hydroprocessing unit 110 may operate with a liquid hour space velocity (LHSV) of from 0.1 per hour ($hr^{-1}$) to 10 $hr^{-1}$, such as from 0.2 $hr^{-1}$ to 10 $hr^{-1}$.

The HDM catalyst, HDS catalyst, and HDA catalyst may each have a bulk density of from 0.3 grams per milliliter (g/ml) to 1.0 g/ml, such as from 0.4 g/ml to 0.8 g/ml. The hydroprocessing unit 110 may include a volume of HDA catalyst greater than a volume of the HDM catalyst, the HDS catalyst, or the volume of both the HDM catalyst and the HDS catalyst. In some embodiments, the hydroprocessing unit 110 may have a volume ratio of the volume HDA catalyst to the volume of the HDM catalyst and the HDS catalyst of from 1:1 to 6:1, such as from 1:1 to 5:1, from 2:1 to 6:1, from 2:1 to 5:1, from 3:1 to 6:1, or from 3:1 to 5:1. In some embodiments, the hydroprocessing unit 110 may include a volume ratio of the volume of HDA catalyst to the combined volume of the HDM catalyst and the HDS catalyst of about 4:1.

Still referring to FIG. 1, the hydroprocessed effluent 103 is passed out of the hydroprocessing unit 110. In some embodiments, at least 20 wt. % of the hydroprocessed effluent 103 may have a boiling point temperature of less than or equal to 225° C. In additional embodiments, at least 5 wt. %, at least 10 wt. %, at least 20 wt. %, or even at least 30 wt. % of the hydroprocessed effluent 103 may have a boiling point temperature of less than or equal to 225° C. In some embodiments, the hydroprocessed effluent 103 may have an initial boiling point (IBP) temperature of less than or equal to 100° C., such as less than or equal to 90° C., less than or equal to 80° C., less than or equal to 70° C., or even less than or equal to 60° C. The hydroprocessed effluent 103 may be characterized by a T5 temperature, which is the temperature below which 5% of the constituents boil. In some embodiments, the hydroprocessed effluent 103 may have a T5 temperature of less than or equal to 150° C., less than or equal to 130° C., less than or equal to 120, less than or equal to 110, or even less than or equal to 100° C. The hydroprocessed effluent 103 may also be characterized by a T95 temperature, which is the temperature at which 95% of the constituents of the hydroprocessed effluent 103 boil. In some embodiments, the hydroprocessed effluent 103 may have a T95 temperature of greater than or equal to 570° C., greater than or equal to 580° C., greater than or equal to 590° C., even greater than or equal to 600° C., or even greater than or equal to 610° C.

In some embodiments, the hydroprocessed effluent 103 may have a density less than the density of the heavy oil 101. In some embodiments, the hydroprocessed effluent 103 may have a density of from 0.80 grams per milliliter (g/mL) to 0.95 g/mL, such as from 0.80 g/mL to 0.90 g/mL, from 0.80 g/mL to 0.85 g/mL, from 0.82 g/mL to 0.95 g/mL, from 0.82 g/mL to 0.90 g/mL, from 0.82 g/mL to 0.85 g/mL, from 0.83 g/mL to 0.95 g/mL, 0.83 g/mL to 0.90 g/mL, or from 0.83 g/mL to 0.85 g/mL. The hydroprocessed effluent 103 may have an API gravity greater than the API gravity of the heavy oil 101 introduced to the hydroprocessing unit 110. In some embodiments, the hydroprocessed effluent 103 may have an API gravity of less than or equal to 50 degrees, or less than or equal to 40 degrees. In some embodiments, the hydroprocessed effluent 103 may have an API from 25 degrees to 50 degrees, from 30 degrees to 50 degrees, from 35 degrees to 45 degrees, or from 35 degrees to 40 degrees. The hydroprocessed effluent 103 may have a sulfur content less than a sulfur content of the heavy oil 101 introduced to the hydroprocessing unit 110. In some embodiments, the hydroprocessed effluent 103 may have a sulfur content of from 0.01 wt. % to 0.10 wt. %, such as from 0.01 wt. % to 0.08 wt. %, from 0.01 wt. % to 0.05 wt. %, from 0.02 wt. % to 0.10 wt. %, from 0.02 wt. % to 0.08 wt. %, or from 0.02 wt. % to 0.07 wt. %. The hydroprocessed effluent 103 may have a nitrogen content less than the nitrogen content of the heavy oil 101. In some embodiments, the hydroprocessed effluent 103 may have a nitrogen content of from 0 parts per million by weight (ppmw) to 500 ppmw, such as from 10 ppmw to 500 ppmw, from 10 ppmw to 400 ppmw, from 10 ppmw to 300 ppmw, from 50 ppmw to 500 ppmw, from 50 ppmw to 400 ppmw, or from 50 ppmw to 300 ppmw.

The hydroprocessed effluent 103 may have a metals content that is less than the metals content of the heavy oil 101 introduced to the hydroprocessing unit 110. In some embodiments, the hydroprocessed effluent 103 may have a metals content of from 0 ppmw to 100 ppmw, such as from 0 ppmw to 75 ppmw, from 0 ppmw to 50 ppmw, from 0 ppmw to 25 ppmw, from 0 ppmw to 10 ppmw, from 0 ppmw to 5 ppmw, from 0.1 ppmw to 100 ppmw, from 0.1 ppmw to 75 ppmw, from 0.1 ppmw to 50 ppmw, from 0.1 ppmw to 25 ppmw, from 0.1 ppmw to 10 ppmw, or from 0.1 ppmw to 5 ppmw. The hydroprocessed effluent 103 may have a nickel content that is less than a nickel content of the heavy oil 101 introduced to the hydroprocessing unit 110. In some embodiments, the hydroprocessed effluent 103 may have a nickel content of from 0 ppmw to 10 ppmw, such as from 0 ppmw to 7.5 ppmw, from 0 ppmw to 5 ppmw, from 0 ppmw to 2.5 ppmw, from 0 ppmw to 1 ppmw, from 0 ppmw to 0.5 ppmw, from 0.1 ppmw to 10 ppmw, from 0.1 ppmw to 7.5 ppmw, from 0.1 ppmw to 5 ppmw, from 0.1 ppmw to 2.5 ppmw, from 0.1 ppmw to 1 ppmw, or from 0.1 ppmw to 0.5 ppmw. The hydroprocessed effluent 103 may have an arsenic content that is less than an arsenic content of the heavy oil 101 introduced to the hydroprocessing unit 110. In some embodiments, the hydroprocessed effluent 103 may have an arsenic content of from 0 ppmw to 1 ppmw, such as from 0 ppmw to 0.75 ppmw, from 0 ppmw to 0.5 ppmw, from 0 ppmw to 0.25 ppmw, from 0 ppmw to 0.1 ppmw, from 0 ppmw to 0.01 ppmw, from 0.01 ppmw to 1 ppmw, from 0.01 ppmw to 0.75 ppmw, from 0.01 ppmw to 0.5 ppmw, from 0.1 ppmw to 0.25 ppmw, from 0.1 ppmw to 0.1 ppmw, or from 0.01 ppmw to 0.001 ppmw. The hydroprocessed effluent 103 may have a vanadium content that is less than a vanadium content of the heavy oil 101 introduced to the hydroprocessing unit 110. In some embodiments, the hydroprocessed effluent 103 may have a vanadium content of from 0 ppmw to 10 ppmw, such as from 0 ppmw to 7.5 ppmw, from 0 ppmw to 5 ppmw, from 0 ppmw to 2.5 ppmw, from 0 ppmw to 1 ppmw, from 0 ppmw to 0.5 ppmw, from 0.1 ppmw to 10 ppmw, from 0.1 ppmw to 7.5 ppmw, from 0.1 ppmw to 5 ppmw, from 0.1 ppmw to 2.5 ppmw, from 0.1 ppmw to 1 ppmw, or from 0.1 ppmw to 0.5 ppmw.

The hydroprocessed effluent 103 may have an aromatics content that is less than the aromatics content of the heavy oil 101 introduced to the hydroprocessing unit 110. In some embodiments, the hydroprocessed effluent 103 may have an aromatics content of from 0.01 wt. % to 1 wt. %, such as from 0.01 wt. % to 0.10 wt. %, from 0.01 wt. % to 0.20 wt. %, from 0.01 wt. % to 0.30 wt. %, from 0.01 wt. % to 0.40 wt. %, from 0.01 wt. % to 0.50 wt. %, or from 0.01 wt. % to 0.75 wt. %. The hydroprocessed effluent 103 may have an asphaltene content that is less than an asphaltene content of the heavy oil 101 introduced to the hydroprocessing unit 110. In some embodiments, the hydroprocessed effluent 103 may have an asphaltene content of from 0.01 wt. % to 1 wt. %, such as from 0.01 wt. % to 0.10 wt. %, from 0.01 wt. % to 0.20 wt. %, from 0.01 wt. % to 0.30 wt. %, from 0.01 wt. % to 0.40 wt. %, from 0.01 wt. % to 0.50 wt. %, or from 0.01 wt. % to 0.75 wt. %. The hydroprocessed effluent 103 may have an MCR content that is less than an MCR content of the heavy oil 101 introduced to the hydroprocessing unit 110. In some embodiments, the hydroprocessed effluent 103 may have an MCR content of from 0.01 wt. % to 3 wt. %, such as from 0.01 wt. % to 2.5 wt. %, from 0.01 wt. % to 2 wt.

%, from 0.01 wt. % to 1.5 wt. %, from 0.01 wt. % to 1 wt. %, from 0.01 wt. % to 0.50 wt. %, or from 0.01 wt. % to 0.75 wt. %.

The hydroprocessed effluent 103 may be passed from the hydroprocessing unit 110 to the HS-FCC unit 120. In some embodiments, the hydroprocessed effluent 103 may be passed directly from the hydroprocessing unit 110 to the HS-FCC unit 120 without subjecting the hydroprocessed effluent 103 to an intervening unit operation, such as a separation, that changes the composition of the hydroprocessed effluent 103. In some embodiments, the hydroprocessed effluent 103 may be passed through a heat exchanger, compressor, analyzer, or other system component that does not change the composition of the hydroprocessed effluent 103 before being passed to the HS-FCC unit 120. In some embodiments, the heavy oil conversion system 100 may include a conduit 166 extending directly from an outlet 164 of the hydroprocessing unit 110 to an inlet 168 of the HS-FCC unit 120. The conduit 166 may be operable to transport the hydroprocessed effluent 103 directly from the outlet 164 of the hydroprocessing unit 110 to the inlet 168 of the HS-FCC unit 120 without passing through a separation device or other unit operation operable to change a composition of the hydroprocessed effluent 103. In some embodiments, the entire hydroprocessed effluent 103 may be passed from the hydroprocessing unit 110 to the HS-FCC unit 120. In some embodiments, one or more slip streams having the same composition as the hydroprocessed effluent 103 may be removed from the hydroprocessed effluent 103 between the hydroprocessing unit 110 and the HS-FCC unit 120 without changing the composition of the hydroprocessed effluent 103.

The HS-FCC unit 120 may be operable to contact the hydroprocessed effluent 103 with a cracking catalyst under high-severity conditions to crack at least a portion of the hydroprocessed effluent 103 to produce a cracked effluent 104 comprising at least one product. In some embodiments, the entire hydroprocessed effluent 103 may be contacted with the cracking catalyst under high-severity conditions in the HS-FCC unit 120. Although the entire hydroprocessed effluent 103 may be contacted with the cracking catalyst, in some embodiments, only a portion of the hydroprocessed effluent 103 may undergo cracking in the HS-FCC unit 120. The HS-FCC unit 120 may include a catalyst-feed mixing zone 121, a reaction zone 122, a separation zone 123, and a catalyst regeneration zone 124. The hydroprocessed effluent 103 may be passed to the catalyst-feed mixing zone 121, where it is mixed with cracking catalyst from the regenerated catalyst stream 125 passed from the catalyst regeneration zone 124 to form a mixture comprising the hydroprocessed effluent 103 and the cracking catalyst. A variety of fluid catalytic cracking catalysts may be suitable for the reactions of the HS-FCC unit 120. Suitable FCC catalysts may include, without limitation, zeolites, silica-alumina, carbon monoxide burning promoter additives, bottoms cracking additives, light olefin-producing additives, and other catalyst additives used in the FCC processes. Examples of cracking zeolites suitable for use in the HS-FCC unit 120 may include, but are not limited to, Y, REY, USY, RE-USY zeolites, or combinations of these. For enhanced light olefins production from naphtha cracking, ZSM-5 zeolite crystal or other pentasil type catalyst structure may be used. Suitable commercially available catalysts include, but are not limited to, HS-FCC-5, OlefinMax® commercially available from Grace Davison, NapthaMax® commercially available from BASF, and OlefinUltra® commercially available from Grace Davison. Other FCC catalysts commercially available from Albemarle, Zeolyst, JGC C&C and other companies may also be suitable for use in the HS-FCC unit 120.

The mixture comprising the hydroprocessed effluent 103 and cracking catalyst may be passed to the reaction zone 122, in which at least a portion of the hydroprocessed effluent 103 may undergo cracking to form one or more chemical products or intermediates. In some embodiments, the reaction zone 122 may be a down-flow reaction zone in which the mixture of hydroprocessed effluent 103 and cracking catalyst are passed downward (i.e., in the −Z direction of the coordinate axis in FIG. 1) through the reaction zone 122. Although described in the context of a down-flow reaction zone, it is understood that the HS-FCC unit 120 may include a reaction zone 122 that is an up-flow reaction zone or any other type of reaction zone.

HS-FCC unit 120 in FIG. 1 is a simplified schematic of one particular embodiment of a HS-FCC unit, and it is understood that other configurations of HS-FCC units may be suitable for incorporation into the heavy oil conversion system 100. The HS-FCC unit 120 may be operable to contact the hydroprocessed effluent 103 with the cracking catalyst under high-severity conditions. As used herein, the term "high severity" refers to reaction conditions that include a reaction temperature of greater than or equal to 500° C., a weight ratio of cracking catalyst to reactant (such as the hydroprocessed effluent 103) of at least 2:1, and a residence time of the reactants (hydroprocessed effluent 103) in contact with the cracking catalyst at the reaction temperature of less than or equal to 30 seconds. In some embodiments, the HS-FCC unit 120 may be operated at a reaction temperature of at least 500° C., at least 550° C., at least 600° C., at least 650° C., at least 700° C., or even at least 750° C. In some embodiments, the reaction temperature in the HS-FCC unit may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C.

In some embodiments, the weight ratio of cracking catalyst to hydroprocessed effluent 103 in the HS-FCC unit 120 at least 2:1, at least 3:1, at least 4:1, at least 5:1, at least 6:1, at least 7:1, or even at least 10:1. In some embodiments, the weight ratio of the cracking catalyst to the hydroprocessed effluent 103 in the HS-FCC unit 120 may be from 2:1 to 40:1, from 2:1 to 30:1, from 2:1 to 20:1, from 2:1 to 10:1, from 4:1 to 40:1, from 4:1 to 30:1, from 4:1 to 20:1, from 4:1 to 10:1, from 6:1 to 40:1, from 6:1 to 30:1, from 6:1 to 20:1, from 6:1 to 10:1, from 8:1 to 40:1, from 8:1 to 30:1, from 8:1 to 20:1, from 8:1 to 10:1, from 10:1 to 40:1, from 10:1 to 30:1, from 10:1 to 20:1, or from 20:1 to 40:1.

In some embodiments, the residence time of the hydroprocessed effluent 103 in contact with the cracking catalyst at the reaction temperature in the HS-FCC unit 120 may be less than 30 seconds (sec), less than 25 sec, less than 20 sec, less than 15 sec, less than 10 sec, less than 5 sec, less than 2.5 sec, less than 1 sec, or less than 0.5 sec. In some embodiments, the residence time of the hydroprocessed effluent 103 in contact with the cracking catalyst at the reaction temperature in the HS-FCC unit 120 may be from 0.2 sec to 30 sec, from 0.2 sec to 25 sec, from 0.2 sec to 20 sec, from 0.2 sec to 15 sec, from 0.2 sec to 10 sec, from 0.2 sec to 5 sec, from 0.2 sec to 2.5 sec, from 0.2 sec to 1 sec, from 0.2 sec to 0.5 sec, from 0.5 sec to 30 sec, from 1 sec to 30 sec, or from 2.5 sec to 30 sec, from 5 sec to 30 sec, from 10 sec to 30 sec, from 15 sec to 30 sec, from 20 sec to 30 sec, or from 25 sec to 30 sec.

Following the cracking reaction in the reaction zone 122, the contents of the reaction zone 122 may be passed to the separation zone 123 where the cracked product of the reaction zone 122 is separated from spent catalyst, which is passed in a spent catalyst stream 126 to the catalyst regeneration zone 124 where it is regenerated by, for example, removing coke from the spent catalyst. The cracked effluent 104 may be passed out of the separation zone 123.

Figure 2:
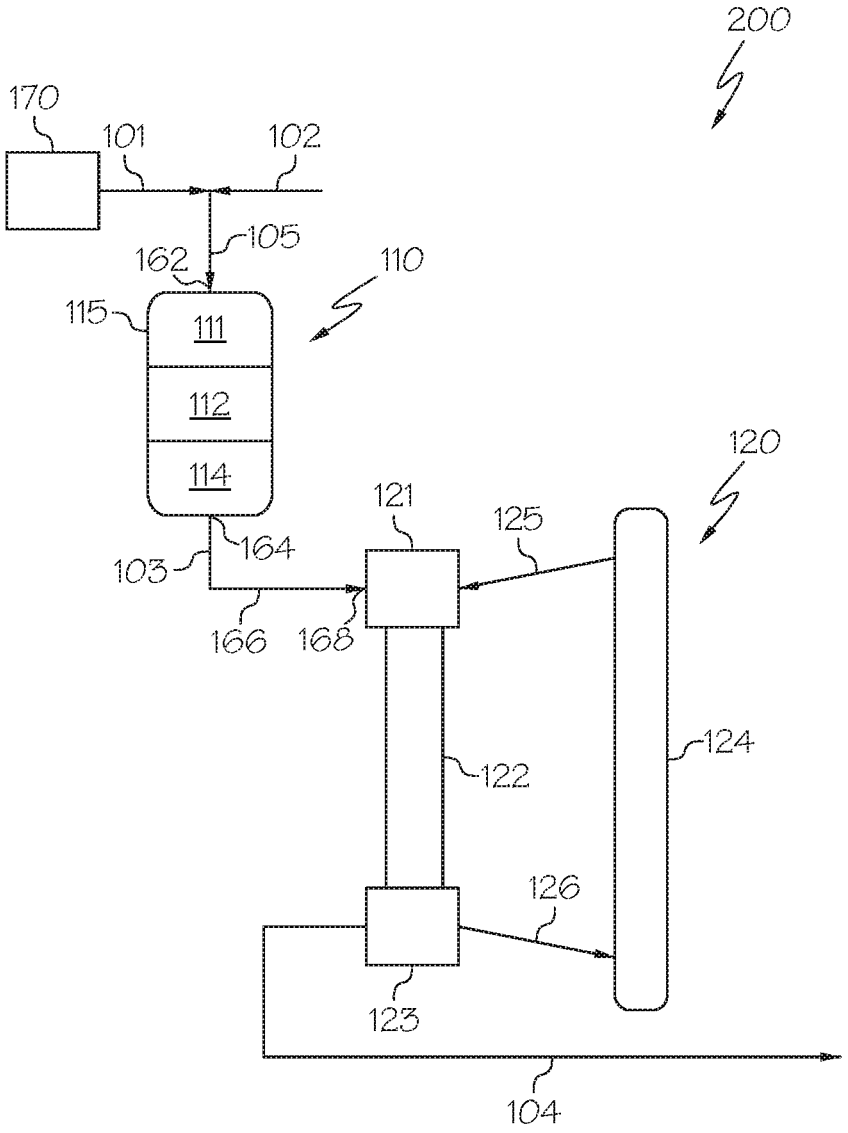
FIG. 2 depicts a generalized schematic diagram of the heavy oil conversion system of FIG. 1, in which the hydroprocessing unit includes an HDM catalyst, an HDS catalyst, and an HDA catalyst disposed in separate catalyst zones within a single reactor, according to one or more embodiments described in this disclosure.

Referring now to FIG. 2, the hydroprocessing unit 110 may include a plurality of packed bed reaction zones arranged in series in a single hydroprocessing reactor 115. For example, in some embodiments, the hydroprocessing unit 110 may include an HDM reaction zone 111, an HDS reaction zone 112, and an HDA reaction zone 114. In some embodiments, each of the HDM reaction zone 111, the HDS reaction zone 112, and the HDA reaction zone 114 may include a catalyst bed. In some embodiments, each of the HDM reaction zone 111, the HDS reaction zone 112, and the HDA reaction zone 114 may be contained in a single reactor, such as a hydroprocessing reactor 115, which may be a packed bed reactor with multiple catalyst beds in series. In such embodiments, the hydroprocessing reactor 115 comprises the HDM reaction zone 111 comprising an HDM catalyst, the HDS reaction zone 112 comprising an HDS catalyst, and the HDA reaction zone 114 comprising an HDA catalyst. The hydroprocessing unit 110 may be a downflow reactor, an upflow reactor, a horizontal flow reactor, or reactor with other types of flow patterns. In some embodiments, the hydroprocessing unit 110 may be a downflow column having the HDM catalyst zone 111 in a top portion of the column, the HDS catalyst zone 112 in a middle portion of the column, and the HDA catalyst zone 114 in a bottom portion of the column. It should be understood that contemplated embodiments include those where packed catalyst beds which are arranged in series are contained in a single reactor or in multiple reactors each containing one or more catalyst beds.

According to one or more embodiments, the heavy oil 101 may be introduced to the HDM reaction zone 111 and may be contacted by the HDM catalyst. Contacting the heavy oil 101 with the HDM catalyst may promote a reaction that removes at least a portion of the metals present in the heavy oil 101. Following contact with the HDM catalyst, the heavy oil 101 may be converted to an HDM reaction effluent. The HDM reaction effluent may have a reduced metal content as compared to the contents of the heavy oil 101. For example, the HDM reaction effluent may have at least 2%, at least 5%, at least 10%, at least 25%, at least 50%, or even at least 75% less metal as the heavy oil 101. According to some embodiments, the HDM reaction zone 111 may have a weighted average bed temperature of from 300° C. to 450° C., such as from 370° C. to 415° C., and may have a pressure of from 30 bars to 200 bars, such as from 90 bars to 110 bars. The HDM reaction zone 111 includes the HDM catalyst, and the HDM catalyst may fill the entirety of the HDM reaction zone 111.

The HDM catalyst may comprise one or more metals from the Groups 5, 6, or 8-10 of the IUPAC periodic table. For example, the HDM catalyst may comprise molybdenum. The HDM catalyst may further comprise a support material, and the metal may be disposed on the support material. The support material may be gamma-alumina or silica/alumina extrudates, spheres, cylinders, beads, pellets, and combinations thereof. In some embodiments, the HDM catalyst may comprise a gamma-alumina support, with a surface area of from 100 meters squared per gram ($m^2/g$) to 160 $m^2/g$, such as from 100 $m^2/g$ to 130 $m^2/g$, or from 130 $m^2/g$ to 160 $m^2/g$. In one embodiment, the HDM catalyst may comprise a molybdenum metal catalyst on an alumina support (sometimes referred to as "$Mo/Al_2O_3$ catalyst"). It should be understood throughout this disclosure that metals contained in any of the disclosed catalysts may be present as sulfides or oxides, or even other compounds.

In some embodiments, the HDM catalyst may comprise from 0.5 wt. % to 12 wt. % of an oxide or sulfide of molybdenum, such as from 2 wt. % to 10 wt. % or from 3 wt. % to 7 wt. % of an oxide or sulfide of molybdenum, and from 88 wt. % to 99.5 wt. % of alumina, such as from 90 wt. % to 98 wt. % or from 93 wt. % to 97 wt. % of alumina.

The HDM catalyst can be best described as having a relatively large pore volume, such as at least 0.8 cubic centimeters per gram ($cm^3/g$) (for example, at least 0.9 $cm^3/g$, or even at least 1.0 $cm^3/g$). The pore size of the HDM catalyst may be predominantly macroporous (that is, having a pore size of greater than 50 nanometers (nm)). This may provide a large capacity for the uptake of metals, and optionally dopants, on the surfaces of the HDM catalyst. In one embodiment, the HDM catalyst may include a dopant comprising one or more compounds that include elements selected from the group consisting of boron, silicon, halogens, phosphorus, and combinations thereof.

The HDM reaction effluent may be passed from the HDM reaction zone 111 to the HDS reaction zone 112 where it is contacted with the HDS catalyst. Contacting the HDM reaction effluent with the HDS catalyst may promote a reaction that removes at least a portion of the sulfur present in the HDM reaction effluent stream. Following contact with the HDS catalyst, the HDM reaction effluent may be converted to a HDS reaction effluent. The HDS reaction effluent may have a reduced sulfur content as compared to the HDM reaction effluent. For example, the HDS reaction effluent may have at least 2%, at least 5%, at least 10%, at least 25%, at least 50%, or even at least 75% less sulfur as the HDM reaction effluent. According to some embodiments, the HDS reaction zone 112 may have a weighted average bed temperature of from 300° C. to 450° C., such as from 370° C. to 415° C., and may have a pressure of from 30 bars to 200 bars, such as from 90 bars to 110 bars. The HDS reaction zone 112 includes the HDS catalyst, and the HDS catalyst may fill the entirety of the HDS reaction zone 112.

In one embodiment, the HDS catalyst comprises one metal from Group 6 and one metal from Groups 8-10 of the IUPAC periodic table. Example Group 6 metals include molybdenum and tungsten and examples of Group 8-10 metals include nickel and cobalt. The HDS catalyst may further comprise a support material, and the metal may be disposed on the support material. In some embodiments, the HDS catalyst may comprise Mo and Ni on a alumina support (sometimes referred to as a "Mo—$Ni/Al_2O_3$ catalyst"). The HDS catalyst may also contain a dopant that is selected from the group consisting of boron, phosphorus, halogens, silicon, and combinations thereof. In one or more embodiments, the HDS catalyst may comprise from 10 wt. % to 18 wt. % of an oxide or sulfide of molybdenum, such as from 11 wt. % to 17 wt. % or from 12 wt. % to 16 wt. % of an oxide or sulfide of molybdenum, from 1 wt. % to 7 wt. % of an oxide or sulfide of nickel, such as from 2 wt. % to 6 wt. % or from 3 wt. % to 5 wt. % of an oxide or sulfide of nickel, and from 75 wt. % to 89 wt. % of alumina such as from 77 wt. % to 87 wt. % or from 79 wt. % to 85 wt. % of alumina.

The HDS catalyst may have a surface area of 140 $m^2/g$ to 200 $m^2/g$, such as from 140 $m^2/g$ to 170 $m^2/g$ or from 170

$m^2/g$ to 200 $m^2/g$. The HDS catalyst can have an intermediate pore volume of from 0.5 $cm^3/g$ to 0.7 $cm^3/g$, such as 0.6 $cm^3/g$. The HDS catalyst may generally comprise a mesoporous structure having pore sizes in the range of 12 nm to 50 nm.

The HDS reaction effluent may be passed from the HDS reaction zone 112 to the HDA reaction zone 114 where it is contacted with the HDA catalyst. Contacting the HDS reaction effluent with the HDA catalyst may promote a reaction that may reduce the concentration of aromatics present in the HDS reaction effluent. Following contact with the HDA catalyst, the HDN reaction effluent may be converted to a HDA reaction effluent. The HDA reaction effluent may be passed out of the hydroprocessing unit 110 as the hydroprocessed effluent 103. The hydroprocessed effluent 103 (HDA reaction effluent) may have a reduced content of aromatic compounds compared to the HDS reaction effluent. For example, the hydroprocessed effluent 103 (HDA reaction effluent) may have at least 2%, at least 5%, at least 10%, at least 25%, at least 50%, or even at least 75% less aromatic compounds compared to the HDN reaction effluent.

The HDA catalyst may comprise one or more metals from Groups 5, 6, 8, 9, or 10 of the IUPAC periodic table. In some embodiments, the HDA catalyst may comprise one or more metals from Groups 5 or 6 of the IUPAC periodic table, and one or more metals from Groups 8, 9, or 10 of the IUPAC periodic table. In some embodiments, the HDA catalyst may comprise molybdenum or tungsten from Group 6 and nickel or cobalt from Groups 8, 9, or 10. The HDA catalyst may further comprise a support material, such as zeolite, and the metal may be disposed on the support material. In one embodiment, the HDA catalyst may comprise tungsten and nickel metal catalyst on a zeolite support that is mesoporous (sometimes referred to as "W—Ni/meso-zeolite catalyst"). In another embodiment, the HDA catalyst may comprise molybdenum and nickel metal catalyst on a zeolite support that is mesoporous (sometimes referred to as "Mo—Ni/meso-zeolite catalyst"). The zeolite support material may not be limited to any particular type of zeolite. However, it is contemplated that zeolites such as Y, Beta, AWLZ-15, LZ-45, Y-82, Y-84, LZ-210, LZ-25, Silicalite, or mordenite framework zeolites may be suitable for use in the presently-described HDA catalyst.

The support material (that is, the mesoporous zeolite) of the HDA catalyst may be characterized as mesoporous by having average pore size of from 2 nm to 50 nm. By way of comparison, conventional zeolite-based hydrocracking catalysts contain zeolites which are microporous, meaning that they have an average pore size of less than 2 nm. Without being bound by theory, it is believed that the relatively large-sized pores (that is, mesoporosity) of the presently-described HDA catalysts allow for larger molecules to diffuse inside the zeolite, which is believed to enhance the reaction activity and selectivity of the catalyst. Because of the increased pore size, aromatic-containing molecules can more easily diffuse into the catalyst and aromatic cracking may increase. For example, in some conventional embodiments, the feedstock converted by the hydroprocessing catalysts may be vacuum gas oils; light cycle oils from, for example, a fluid catalytic cracking reactor; or coker gas oils from, for example, a coking unit. The molecular sizes in these oils are relatively small compared to those of heavy oils such as crude and atmosphere residue, which may be the feedstock of the present methods and systems. The heavy oils generally are unable to diffuse inside the conventional zeolites and be converted on the active sites located inside the zeolites. Therefore, zeolites with larger pore sizes (that is, mesoporous zeolites) may allow the larger molecules of heavy oils to overcome the diffusion limitation, and may promote the reaction and conversion of the larger molecules of the heavy oils.

In one or more embodiments, the HDA catalyst may comprise from 18 wt. % to 28 wt. % of a sulfide or oxide of tungsten, such as from 20 wt. % to 27 wt. % or from 22 wt. % to 26 wt. % of tungsten or a sulfide or oxide of tungsten, from 2 wt. % to 8 wt. % of an oxide or sulfide of nickel, such as from 3 wt. % to 7 wt. % or from 4 wt. % to 6 wt. % of an oxide or sulfide of nickel, and from 5 wt. % to 40 wt. % of mesoporous zeolite, such as from 10 wt. % to 35 wt. % or from 10 wt. % to 30 wt. % of zeolite. In another embodiment, the HDA catalyst may comprise from 12 wt. % to 18 wt. % of an oxide or sulfide of molybdenum, such as from 13 wt. % to 17 wt. % or from 14 wt. % to 16 wt. % of an oxide or sulfide of molybdenum, from 2 wt. % to 8 wt. % of an oxide or sulfide of nickel, such as from 3 wt. % to 7 wt. % or from 4 wt. % to 6 wt. % of an oxide or sulfide of nickel, and from 5 wt. % to 40 wt. % of mesoporous zeolite, such as from 10 wt. % to 35 wt. % or from 10 wt. % to 30 wt. % of mesoporous zeolite.

It should be understood that some embodiments of the presently-described methods and systems may utilize a HDA catalyst that includes a mesoporous zeolite (that is, having an average pore size of from 2 nm to 50 nm). However, in other embodiments, the average pore size of the zeolite may be less than 2 nm (that is, microporous).

According to one or more embodiments described, the volumetric ratio of HDM catalyst:HDS catalyst:HDA catalyst in the hydroprocessing unit 110 may be 5-20:5-30:5-30. The ratio of catalysts may depend at least partially on the metal content in the oil feedstock processed.

Figure 3:
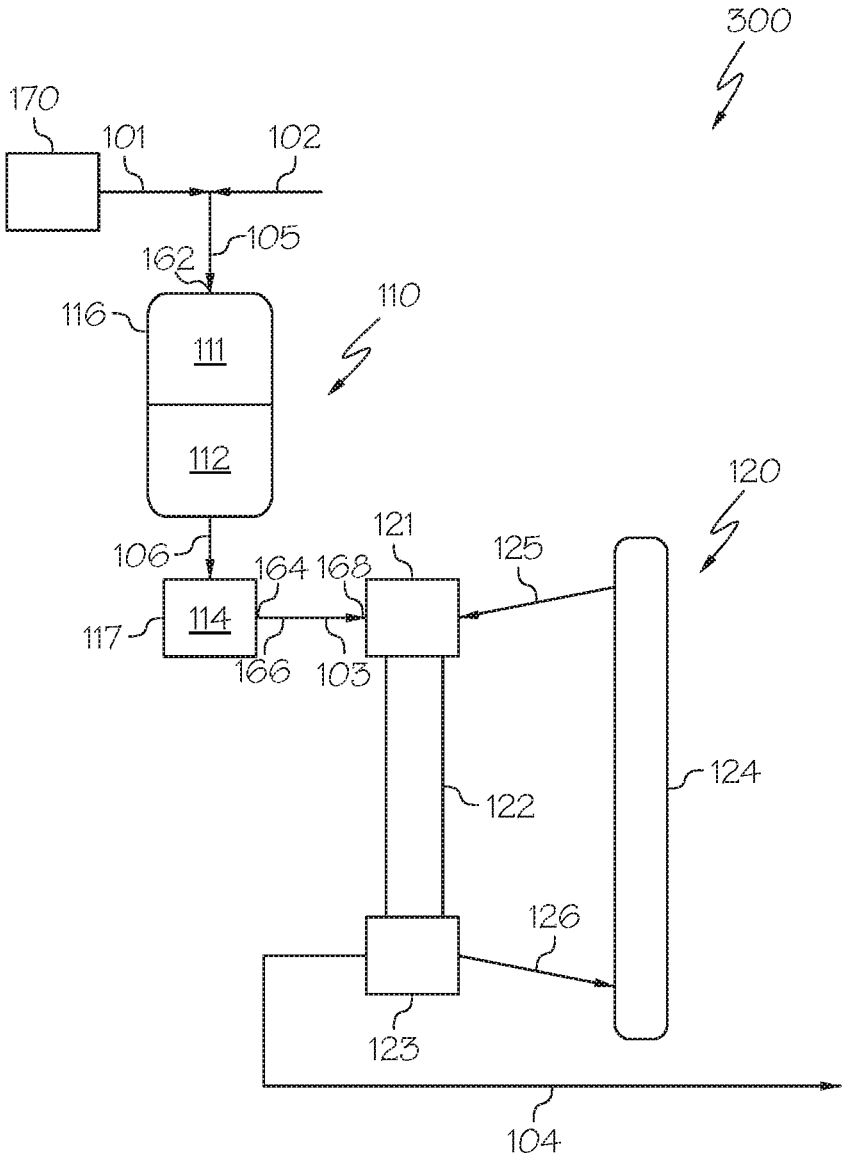
FIG. 3 depicts a generalized schematic diagram of another embodiment of a heavy oil conversion system in which a hydroprocessing unit includes an HDM catalyst and an HDN catalyst in a first reactor and an HDA catalyst in a second reactor downstream of the first reactor, according to one or more embodiments described in this disclosure.

Referring now to FIG. 3, a heavy oil conversion system 300 is depicted in which the hydroprocessing unit 110 may include or consist of multiple packed bed reaction zones arranged in series (for example, an HDM reaction zone 111 and an HDS reaction zone 112) and each of these reaction zones may comprise a catalyst bed. Each of these zones may be contained in a single reactor as a packed bed reactor with multiple beds in series, shown as an upstream packed bed hydroprocessing reactor 116 in FIG. 3, and a downstream packed bed hydrocracking reactor 117. The upstream packed bed hydroprocessing reactor 116 or plurality of upstream packed bed reactors may include the HDM reaction zone 111 and the HDS reaction zone 112. The downstream packed bed hydrocracking reactor 117 may include the HDA reaction zone 114. In such embodiments, the HDM reaction zone 111, the HDS reaction zone 112, and the HDA reaction zone 114 may utilize the respective catalysts and processing conditions disclosed with respect to the system of FIG. 2. The configuration of the upstream packed bed hydroprocessing reactor 116 or plurality of upstream packed bed reactors of FIG. 3 may enable the use of different reaction conditions such as, but not limited to, hydrogen content, temperature, or pressure are different for operation of the upstream packed bed hydroprocessing reactor 116 or plurality of upstream packed bed reactors and the downstream packed bed hydrocracking reactor 117. In such embodiments, the HDS reaction effluent 106 may be passed from the upstream packed bed hydroprocessing reactor 116 or plurality of upstream packed bed reactors to the downstream packed bed hydrocracking reactor 117.

Figure 4:
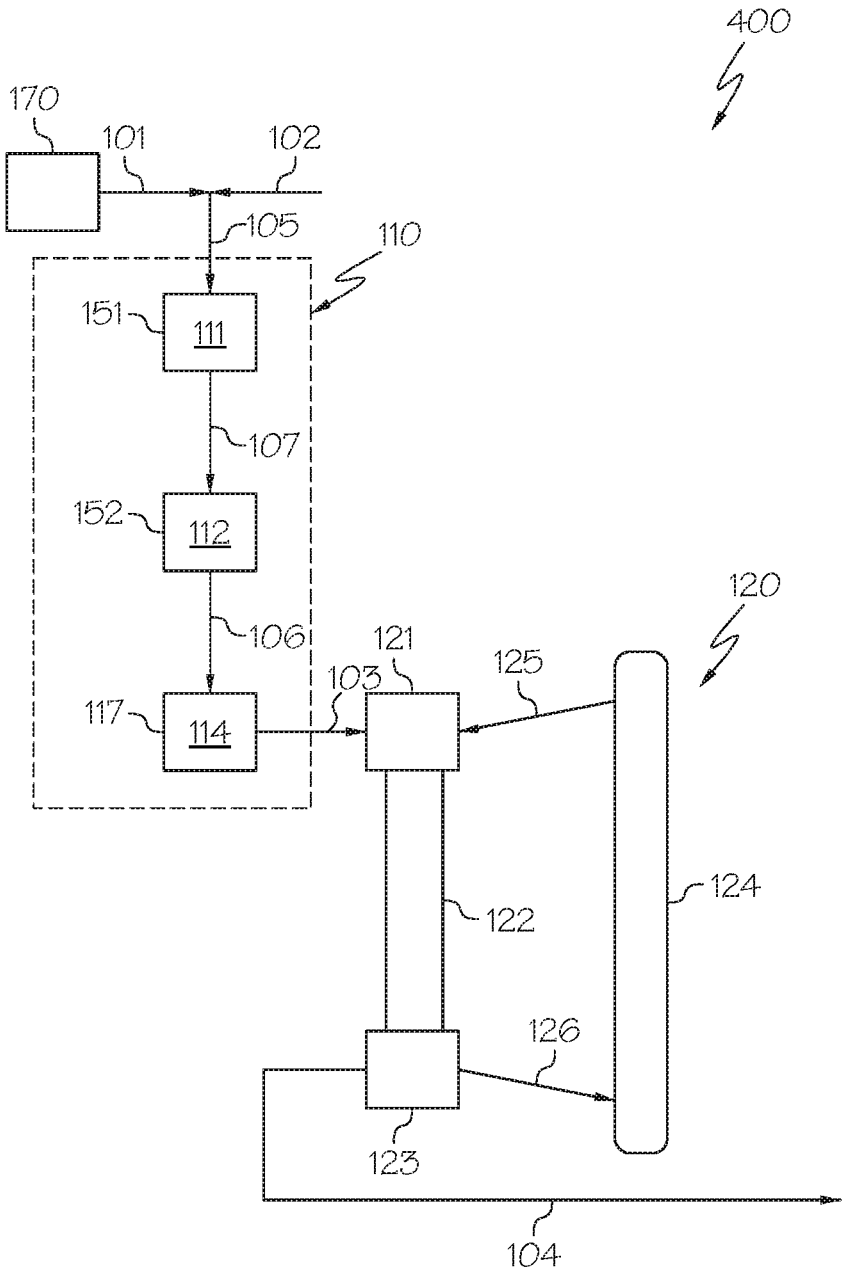
FIG. 4 depicts a generalized schematic diagram of another embodiment of a heavy oil conversion system in which a hydroprocessing unit includes an HDM catalyst, an HDS catalyst, and an HDA catalyst each in separate reactors arranged in series, according to one or more embodiments described in this disclosure.

Referring now to FIG. 4, a heavy oil conversion system 400 is depicted in which the hydroprocessing unit 110 may include or consist of multiple packed bed reaction zones contained in a plurality of packed bed reactors arranged in series with a downstream packed bed hydrocracking reactor 117. In some embodiments, the HDM reaction zone 111 may be contained in an HDM reactor 151, the HDS reaction zone 112 may be contained in an HDS reactor 152, and the HDA reaction zone 114 may be contained in the downstream packed bed hydrocracking reactor 117. The heavy oil 101 is introduced to the HDM reaction zone 111 in the HDM reactor 151 and may be converted to an HDM reaction effluent 107. The HDM reaction effluent 107 may be passed to the HDS reaction zone 112 in the HDS reactor 152 and may be converted to an HDS reaction effluent 106. The HDS reaction effluent 106 may be passed to the HDA reaction zone 114 in the downstream packed bed hydrocracking reactor 117 and may be converted to hydroprocessed effluent 103. In such embodiments, the HDM reaction zone 111, the HDS reaction zone 112, and the HDA reaction zone 114 may utilize the respective catalysts and processing conditions previously discussed with respect to the system of FIG. 2.

Figure 5:
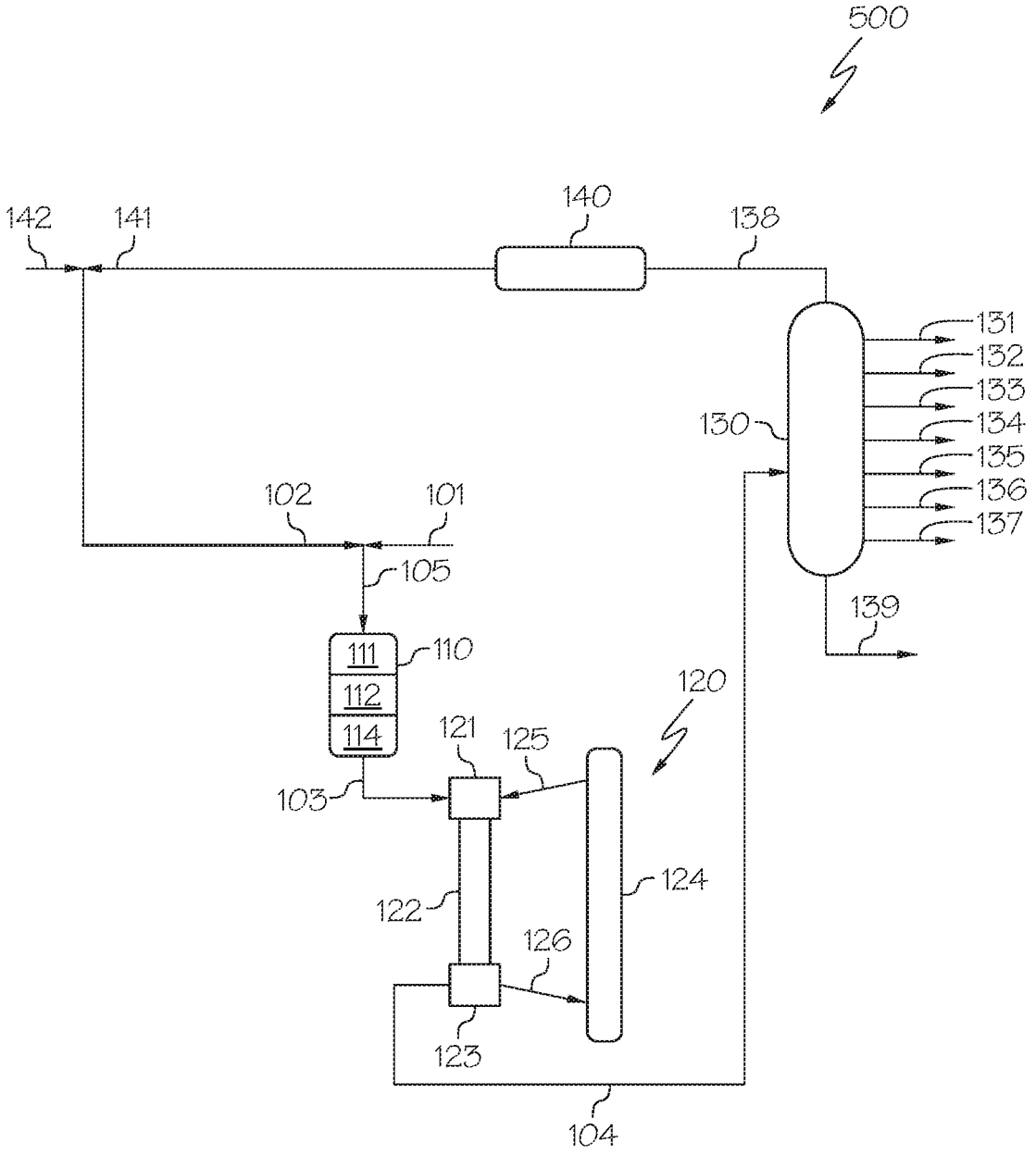
FIG. 5 depicts a generalized schematic diagram of the heavy oil conversion system of FIG. 2, which includes a separation unit disposed downstream of the HS-FCC unit, according to one or more embodiments described in this disclosure.

Now referring to FIG. 5, a heavy oil conversion system 500 is depicted that may include a separation unit 130 downstream of the HS-FCC unit 120. The cracked effluent 104 may be passed from the separation zone 123 of the HS-FCC unit 120 to the separation unit 130, which may be operable to separate the cracked effluent 104 into a plurality of streams, which may include at least one product stream and a bottoms stream 139. In some embodiments, the separation unit 130 may be a distillation or fractionation column operable to separate the contents of the cracked effluent 104 into one or more product streams, such as a hydrocarbon oil stream 131, a gasoline stream 132, a mixed butenes stream 133, a butadiene stream 134, a propene stream 135, an ethylene stream 136, a methane stream 137, a hydrogen stream 138, or combinations of these. As used in this disclosure, the product streams (such as the hydrocarbon oil stream 131, the gasoline stream 132, the mixed butenes stream 133, the butadiene stream 134, the propene stream 135, the ethylene stream 136, and the methane stream 137) may be referred to as petrochemical products, which may be used as intermediates in downstream chemical processing.

The hydrogen stream 138 may be processed by a hydrogen purification unit 140 and recycled back into the heavy oil conversion system 500 as a purified hydrogen stream 141. The purified hydrogen stream 141 may be supplemented with additional feed hydrogen from feed hydrogen stream 142. Alternatively, all or at least a portion of the hydrogen stream 138 or the purified hydrogen stream 141 may exit the system as system products or be burned for heat generation.

While the present description and examples are provided in the context of crude oil as the material of the heavy oil 101, it should be understood that the heavy oil conversion systems 100, 200, 300, 400, 500 described with respect to the embodiments of FIGS. 1-5, respectively, may be applicable for the conversion of a wide variety of heavy oils, (in heavy oil 101), including, but not limited to, crude oil, vacuum residue, tar sands, bitumen, atmospheric residue, and vacuum gas oils.

EXAMPLES

The various embodiments of methods and systems for the processing of heavy oils will be further clarified by the following examples. The examples are illustrative in nature, and should not be understood to limit the subject matter of the present disclosure.

Example 1: Hydroprocessing Crude Oil

In Example 1, crude oil was hydroprocessed in a pilot-plant-sized hydroprocessing unit comprising an HDM catalyst (commercially available as KFR-22 from Albemarle), an HDS catalyst (commercially available as KFR-33 from Albemarle), and a HDA catalyst (commercially available as KFR-70 from Albemarle) to reduce the concentration of metals, sulfur, nitrogen, and aromatic compounds in the crude oil. The hydroprocessing unit consisted of a packed column with the HDM catalyst bed on the top, the HDS catalyst bed in the middle, and the HDA catalyst bed on the bottom. The HDM catalyst bed had a volume of 70 mL with a bulk density of 0.5 g/mL. The HDS catalyst bed had a volume of 70 mL with a bulk density of 0.6 g/mL. The HDA catalyst bed had a volume of 560 mL with a bulk density of 0.7 g/mL. For Example 1, the crude oil was Arab light crude oil, the properties of which are provided previously in this disclosure in Table 1. The hydroprocessing unit was operated at a temperature of 390° C. and an LHSV of 0.2 $h^{-1}$. The total liquid product (TLP) was collected form the hydroprocessing unit and properties of the TLP were analyzed according to the methods shown in Table 2. These properties included density, API, carbon content, hydrogen content, sulfur content, nitrogen content, asphaltene (aromatic) content, MCR (carbonaceous residue formed after the evaporation and pyrolysis of the TLP), metal content, mercury content, boiling point temperatures, the PIONA (n-Paraffin, iso-paraffin, olefin, naphthene, and aromatic) characterization, and hydrocarbon structure.

TABLE 2

| | Method |
|---|---|
| Density | ASTM D287 |
| API | ASTM D287 |
| Carbon Content | ASTM D5291 |
| Hydrogen Content | ASTM D5292 |
| Sulfur Content | ASTM D5453 |
| Nitrogen Content | ASTM D4629 |
| Asphaltenes (Aromatic) Content | ASTM D6560 |
| Micro Carbon Residue (MCR) | ASTM D4530 |
| Metal (V, Ni, As) Content | IP 501 |
| Hg Content | ASTM D7622 |
| SimDis (Boiling Point) | ASTM D7169 |
| PIONA | D5443 |
| Hydrocarbon Structure | NOISE |

Table 3 shows the Arab light crude oil utilized as the heavy oil feed before and after hydroprocessing.

TABLE 3

| Properties | Raw Arab Light Crude Oil Feedstock | Hydroprocessed Arab Light Crude Oil |
|---|---|---|
| API | 33.13 | 40.14 |
| Density (g/ml) | 0.8595 | 0.8484 |
| Carbon content (wt. %) | 85.29 | 85.57 |
| Hydrogen content (wt. %) | 12.68 | 14.43 |
| Sulfur Content (wt. %) | 1.94 | 0.051 |
| Nitrogen Content (wPPm) | 849 | 206 |
| Aromatic Content (wt. %) | 1.2 | <0.5 |
| Metal Content (wppm) | 29.04 | 4.15 |
| Boiling Point Distribution Data | | |
| Composition (wt. %) | Boiling Temperature | |
| Initial Boiling Point | 33° C. | 57° C. |
| 5.0 | 92° C. | 98° C. |
| 10.0 | 133° C. | 156° C. |
| 20.0 | 192° C. | 219° C. |
| 30.0 | 251° C. | 224° C. |

TABLE 3-continued

| | | |
|---|---|---|
| 40.0 | 310° C. | 313° C. |
| 50.0 | 369° C. | 356° C. |
| 60.0 | 432° C. | 400° C. |
| 70.0 | 503° C. | 448° C. |
| 80.0 | 592° C. | 503° C. |
| 90.0 | >720° C. | 570° C. |
| 95.0 | >720° C. | 622° C. |
| Final Boiling Point | >720° C. | 708° C. |

Example 2

In Example 2, the hydroprocessed effluent produced in Example 1 was subjected to fluidized catalytic cracking under high-severity conditions. Product yields were determined by experimentation of three runs with a Sakuragi Rikagaku Micro Activity Test (MAT) unit using a quartz tubular reactor. The quartz tubular reactor was a fixed bed fluidized catalyst reactor sufficient to simulate the HS-FCC units 120 previously described in the present disclosure. The three runs were conducted over a blend of commercial catalysts composed of 75 wt. % HS-FCC-5 and 25 wt. % OlefinMax® catalyst commercially available from Grace Davidson. Prior to introducing the hydroprocessed effluent of Example 1, all catalysts were steamed at 810° C. for 6 hours prior to the reaction. The first run was conducted with a weight ratio of catalyst to reactant of 2.88, the second run with a ratio of 5.13, and the third run with a ratio of 8.54. Each run was conducted in the MAT unit at 650° C. with a 30 second time-on-stream (TOS) and after each run the catalysts were stripped using a 30 milliliters per minute (mL/min) nitrogen gas flow. The liquid product was collected in the liquid receiver and the gaseous product were collected in a gas burette by water displacement and analyzed. The spent catalysts were used to measure the amount of coke generated from the reaction. Table 4 shows the results of cracking the hydroprocessed crude oil of Table 2 in the MAT unit under high-severity conditions.

TABLE 4

| Run No. | 1 | 2 | 3 |
|---|---|---|---|
| Temperature (° C.) | 650 | 650 | 650 |
| Catalyst to Oil Ratio | 2.88 | 5.13 | 8.54 |
| Conversion (%) | 78.01 | 81.05 | 81.74 |
| Yields (wt. %) | | | |
| Hydrogen ($H_2$) | 0.253 | 0.336 | 0.395 |
| Methane (C1) | 3.71 | 4.71 | 4.73 |
| Ethane (C2) | 2.98 | 3.62 | 3.73 |
| Ethylene (C2=) | 8.83 | 10.58 | 11.11 |
| Propane (C3) | 1.73 | 1.94 | 2.73 |
| Propene (C3=) | 20.04 | 20.77 | 21.38 |
| Isobutane (iC4) | 0.80 | 0.66 | 1.11 |
| n-Butane (nC4) | 0.53 | 0.55 | 0.78 |
| trans-2-Butene (t2C4=) | 2.82 | 2.70 | 2.55 |
| 1-Butene (1C4=) | 2.55 | 2.44 | 2.30 |
| Isobutene (iC4=) | 4.46 | 4.19 | 3.91 |
| cis-2-Butene (c2C4=) | 2.08 | 1.97 | 1.87 |
| 1,3-Butadiene (1,3-BD) | 0.20 | 0.17 | 0.14 |
| C4= (Liq.) | 0.08 | 0.12 | 0.07 |
| Total Gas | 51.10 | 54.76 | 56.80 |
| Gasoline | 25.38 | 23.87 | 21.78 |
| Light Cycle Oil (LCO) | 15.54 | 13.54 | 12.07 |
| Heavy Cycle Oil (HCO) | 6.45 | 5.40 | 6.20 |
| Coke | 1.53 | 2.43 | 3.15 |

TABLE 4-continued

| Run No. | 1 | 2 | 3 |
|---|---|---|---|
| Groups (wt. %) | | | |
| H2—C2 (Dry Gas) | 15.78 | 19.25 | 19.97 |
| C3—C4 (LPG) | 35.31 | 35.51 | 36.84 |
| C2= - C4= (Light Olefins) | 41.08 | 42.94 | 43.33 |
| C3= + C4= | 32.25 | 32.36 | 32.22 |
| C4= (Butenes) | 12.21 | 11.59 | 10.84 |
| Molar Ratios | | | |
| C2=/C2 | 3.17 | 3.14 | 3.19 |
| C3=/C3 | 12.17 | 11.24 | 8.21 |
| C4=/C4 | 9.46 | 9.88 | 5.95 |
| iC4=/C4= | 0.37 | 0.36 | 0.36 |
| iC4=/iC4 | 5.55 | 6.31 | 3.52 |

As shown in Table 4, all three runs resulted in the conversion of over 41% of the hydroprocessed crude oil to light olefins. Specifically, over 8% was converted to ethylene, over 20% was converted to propene, and over 10% were converted to butene. As the weight ratio of catalyst to oil was increased from Run 1 to Run 3, the total conversion to light olefin increased, however the conversion to butene specifically decreased. Further, the production of coke increased with the increase in the weight ratio as well. When compared to processes which only feed a heavy fraction of crude oil feedstock to an HS-FCC unit, the process of Example 2 achieved similar total conversion rates of a stream comprising both a heavy and light fraction and produced higher propylene yields.

Comparative Example 3

In Comparative Example 3, the hydroprocessed effluent produced in Example 1 was fractionated into a light fraction with a maximum boiling point of less than 350° C. and a heavy fraction with a minimum boiling point of greater than 350° C. Both fractions were then subjected separately to fluidized catalytic cracking under high-severity conditions as described in Example 2. Product yields were determined by experimentation of six runs, three runs for each of the light fraction (boiling temperature less than 350° C.) and the heavy fraction (boiling temperature greater than 350° C.). Each run was conducted with a different weight ratio of catalyst to reactant (catalyst to oil ratio). Table 5 shows the results of fractionating the hydroprocessed crude oil of Table 2 prior to cracking in the MAT unit under high-severity conditions.

TABLE 5

| Run No. | 4 | 5 | 6 | 7 | 8 | 9 |
|---|---|---|---|---|---|---|
| Feed | Light Fraction | Light Fraction | Light Fraction | Heavy Fraction | Heavy Fraction | Heavy Fraction |
| Temperature (° C.) | 640 | 640 | 640 | 600 | 600 | 600 |
| Catalyst to Oil Ratio | 2.93 | 4.54 | 7.53 | 2.84 | 4.69 | 8.53 |
| Conversion (%) | 86.19 | 86.83 | 90.52 | 61.99 | 76.03 | 80.59 |
| Yields (wt. %) | | | | | | |
| Hydrogen ($H_2$) | 0.138 | 0.158 | 0.249 | 0.134 | 0.231 | 0.304 |
| Methane (C1) | 2.06 | 1.78 | 2.91 | 2.13 | 3.02 | 3.40 |
| Ethane (C2) | 1.75 | 1.57 | 2.50 | 1.85 | 2.65 | 2.99 |
| Ethylene (C2=) | 5.81 | 6.14 | 8.71 | 5.42 | 7.75 | 9.57 |
| Propane (C3) | 1.81 | 2.65 | 3.69 | 1.98 | 2.67 | 3.95 |
| Propene (C3=) | 17.73 | 19.03 | 21.97 | 16.55 | 20.28 | 21.10 |

TABLE 5-continued

| Run No. | 4 | 5 | 6 | 7 | 8 | 9 |
|---|---|---|---|---|---|---|
| Isobutane (iC4) | 1.94 | 2.93 | 3.24 | 1.03 | 1.57 | 2.48 |
| n-Butane (nC4) | 0.86 | 1.32 | 1.53 | 0.71 | 0.91 | 1.27 |
| trans-2-Butene (t2C4=) | 2.72 | 2.78 | 2.72 | 2.71 | 3.11 | 2.84 |
| 1-Butene (1C4=) | 2.32 | 2.44 | 2.45 | 2.22 | 2.57 | 2.37 |
| Isobutene (iC4=) | 4.25 | 4.40 | 4.27 | 4.42 | 4.94 | 4.43 |
| cis-2-Butene (c2C4=) | 2.05 | 2.12 | 2.09 | 2.07 | 2.34 | 2.13 |
| 1,3-Butadiene (1,3-BD) | 0.14 | 0.15 | 0.16 | 0.09 | 0.28 | 0.33 |
| C4= (Liq.) | 0.30 | 0.18 | 0.11 | 0.10 | 0.04 | 0.00 |
| Total Gas | 43.87 | 47.65 | 56.59 | 41.42 | 52.36 | 57.16 |
| Gasoline | 42.04 | 38.75 | 33.08 | 19.32 | 20.79 | 19.92 |
| Light Cycle Oil (LCO) | 12.91 | 12.09 | 8.42 | 11.07 | 12.38 | 7.07 |
| Heavy Cycle Oil (HCO) | 0.90 | 1.09 | 1.06 | 26.94 | 11.58 | 12.35 |
| Coke | 0.27 | 0.43 | 0.86 | 1.24 | 2.89 | 4.51 |
| Groups (wt. %) | | | | | | |
| H2—C2 (Dry Gas) | 9.76 | 9.64 | 14.37 | 9.54 | 13.65 | 16.26 |
| C3—C4 (LPG) | 34.12 | 38.00 | 42.22 | 31.88 | 38.71 | 40.90 |
| C2= - C4= (Light Olefins) | 35.32 | 37.24 | 42.47 | 33.57 | 41.31 | 42.77 |
| C3= + C4= | 29.51 | 31.10 | 33.76 | 28.15 | 33.56 | 33.20 |
| C4= (Butenes) | 11.79 | 12.07 | 11.79 | 11.60 | 13.28 | 12.10 |
| Molar Ratios | | | | | | |
| C2=/C2 | 3.56 | 4.18 | 2.74 | 3.14 | 3.13 | 3.43 |
| C3=/C3 | 10.26 | 7.52 | 6.24 | 8.74 | 7.94 | 5.60 |
| C4=/C4 | 4.38 | 2.95 | 2.56 | 6.89 | 5.57 | 3.35 |
| iC4=/C4= | 0.36 | 0.36 | 0.36 | 0.38 | 0.37 | 0.37 |
| iC4=/iC4 | 2.20 | 1.50 | 1.32 | 4.28 | 3.16 | 1.78 |

Comparison of Example 2 to Comparative Example 3

The process of Example 2 provides increased production of light olefins compared to Comparative Example 3. As shown in Table 4, the process of Example 2 resulted in light olefin yields of 41.08 wt. %, 42.94 wt. %, and 43.33 wt. % for an average yield of 42.45 wt. %. In contrast, as shown in Table 5, the process of Comparative Example 3, in which the hydroprocessed effluent is fractionated before conducting the fluidized catalytic cracking, resulted in an average yield of light olefins of 38.78 wt. %. Thus, in accordance with the process of the present disclosure, passing the hydroprocessed effluent directly to the HS-FCC unit 120 without any intervening fractionation or separation process may provide for a nearly 4 wt. % increase in the yield of light olefins compared to processes which rely on an intervening separation step.

Further, the process of Example 2 provides decreased production of alkanes when compared to Comparative Example 3. As shown in Table 4, the process of Example 2 resulted in ratios of propene yield to propane yield of 12.17, 11.24, and 8.24 for an average ratio of 10.55. Similarly, the process of Example 2 resulted in ratios of butene yield to butane yield of 9.46, 9.88, and 5.95 for an average ratio of 8.43. In contrast, as shown in Table 5, the comparative process of Comparative Example 3 only resulted in an average ratio of propene yield to propane yield of 7.72 and an average ratio of butene yield to butane yield of 4.28. That is, the processes of the present disclosure, in which the hydroprocessed effluent is passed directly to the HS-FCC unit without an intervening separation step, provide greater selectivity of light olefins (ethylene, propylene, butene) over light alkanes (ethane, propane, butane) compared to processes having an intervening separation step. Therefore, the process of the present disclosure may increase the efficiency of both the process and the product yield compared to processes which rely on the fractionation of feedstreams prior to hydroprocessing and catalytic cracking.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A method for processing heavy oil, the method comprising:

introducing a heavy oil directly to a hydroprocessing unit, the hydroprocessing unit being operable to hydroprocess the heavy oil to form a hydroprocessed effluent by contacting the heavy oil with a hydrodemetalization (HDM) catalyst, a hydrodesulfurization (HDS) catalyst, and a hydrodearomatization (HDA) catalyst;

passing the hydroprocessed effluent directly to a high-severity fluidized catalytic cracking (HS-FCC) unit, the HS-FCC unit being operable to contact the hydroprocessed effluent with a cracking catalyst, where at least a portion of the hydroprocessed effluent is cracked to form a cracked effluent comprising at least one product; and passing the cracked effluent out of the HS-FCC unit, where the heavy oil has an American Petroleum Institute (API) gravity of from 25 degrees to 50 degrees and at least 20 weight percent (wt. %) of the hydroprocessed effluent passed to the HS-FCC unit has a boiling point less than 225 degrees Celsius (° C.).

2. The method of claim 1, in which the heavy oil comprises crude oil.

3. The method of claim 1, further comprising passing the cracked effluent to a separation unit operable to separate the cracked effluent into at least one product stream and a bottoms stream.

4. The method of claim 1, in which the at least one product comprises one or more olefins selected from ethylene, propene, butene, or combinations of these.

5. The method of claim 1, in which the hydroprocessed effluent has a sulfur content of less than 0.1 wt. % and a nitrogen content of less than 500 parts per million by weight (ppmw).

6. The method of claim 1, in which the hydroprocessed effluent has a density of from 0.80 grams per cubic centimeter ($g/cm^3$) to 0.95 $g/cm^3$.

7. The method of claim 1, in which:

the HDM catalyst and the HDS catalyst are positioned in series in a plurality of reactors; and the HDA catalyst is positioned in a reactor downstream of the plurality of reactors.

8. The method of claim 1, in which the HDM catalyst, the HDS catalyst, and the HDA catalyst are positioned in series in a plurality of packed bed reaction zones.

9. The method of claim 8, in which each of the plurality of packed bed reaction zones are contained in a single reactor comprising the plurality of packed bed reaction zones.

10. The method of claim 1, comprising cracking the hydroprocessed effluent in the HS-FCC unit at a temperature greater than or equal to 500° C.

11. The method of claim 1, in which the cracking of the hydroprocessed effluent comprises contacting the hydroprocessed effluent with a fluidized catalytic cracking (FCC) catalyst in the HS-FCC unit at a weight ratio of the FCC catalyst to the hydroprocessed effluent of from 2:1 to 40:1.

12. The method of claim 11, comprising contacting the hydroprocessed effluent with the FCC catalyst from 0.2 seconds to 30 seconds.

13. A method for processing a heavy oil, the method comprising:

introducing the heavy oil directly to a hydroprocessing unit;

hydroprocessing the heavy oil to form a hydroprocessed effluent by contacting the heavy oil with a hydrodemetalization (HDM) catalyst, a hydrodesulfurization (HDS) catalyst, and a hydrodearomatization (HDA) catalyst in the hydroprocessing unit; and contacting the hydroprocessed effluent with a cracking catalyst in a high-severity fluidized catalytic cracking (HS-FCC) unit to form a cracked effluent comprising at least one product;

where the heavy oil has an American Petroleum Institute (API) gravity of from 25 degrees to 50 degrees and at least 20 weight percent (wt. %) of the hydroprocessed effluent passed to the HS-FCC unit has a boiling point less than 225 degrees Celsius (° C.).

14. The method of claim 13, in which the heavy oil comprises crude oil.

15. The method of claim 13, further comprising recovering at least a portion of the at least one product from the cracked effluent.

16. The method of claim 13, in which the at least one product comprises one or more olefins selected from ethylene, propene, butene, or combinations of these.

17. The method of claim 13, in which the hydroprocessed effluent has a sulfur content of less than 0.1 wt. % and nitrogen content of less than 400 parts per million by weight (ppmw).

18. The method of claim 13, in which the hydroprocessed effluent has a density of from 0.80 grams per cubic centimeter ($g/cm^3$) to 0.95 $g/cm^3$.

19. The method of claim 13, in which:

the HDM catalyst and the HDS catalyst are positioned in series in a plurality of reactors; and the HDA catalyst is positioned in a reactor downstream of the plurality of reactors.

20. The method of claim 13, in which the HDM catalyst, the HDS catalyst, and the HDA catalyst are positioned in series in a plurality of packed bed reaction zones.

21. The method of claim 20, in which each of the plurality of packed bed reaction zones are contained in a single reactor comprising the plurality of packed bed reaction zones.

22. The method of claim 13, comprising cracking the hydroprocessed effluent in the HS-FCC unit at a temperature greater than or equal to 500° C.

23. The method of claim 13, in which cracking the hydroprocessed effluent comprises contacting the hydroprocessed effluent with a fluidized catalytic cracking (FCC) catalyst in the HS-FCC unit at a weight ratio of the FCC catalyst to the hydroprocessed effluent of from 2:1 to 40:1.

24. The method of claim 23, comprising contacting the hydroprocessed effluent with the FCC catalyst for a residence time of from 0.2 seconds to 30 seconds.

* * * * *